US009735483B2

(12) United States Patent
Nakamura

(10) Patent No.: US 9,735,483 B2
(45) Date of Patent: Aug. 15, 2017

(54) CONTACT

(71) Applicant: KITAGAWA INDUSTRIES CO., LTD., Inazawa-shi (JP)

(72) Inventor: Tatsuya Nakamura, Inazawa (JP)

(73) Assignee: KITAGAWA INDUSTRIES CO., LTD., Inazawa-Shi, Aichi (JP)

( * ) Notice: Subject to any disclaimer, the term of this patent is extended or adjusted under 35 U.S.C. 154(b) by 37 days.

(21) Appl. No.: 14/442,125

(22) PCT Filed: Nov. 1, 2013

(86) PCT No.: PCT/JP2013/079756
§ 371 (c)(1),
(2) Date: May 12, 2015

(87) PCT Pub. No.: WO2014/073495
PCT Pub. Date: May 15, 2014

(65) Prior Publication Data

US 2016/0294078 A1 Oct. 6, 2016

(30) Foreign Application Priority Data

Nov. 12, 2012 (JP) ..... 2012-248606

(51) Int. Cl.
*H01R 12/00* (2006.01)
*H01R 12/57* (2011.01)
(Continued)

(52) U.S. Cl.
CPC ..... *H01R 12/57* (2013.01); *H01R 12/714* (2013.01); *H01R 13/2407* (2013.01);
(Continued)

(58) Field of Classification Search
CPC .. H01R 12/57; H01R 12/716; H01R 13/2407; H01R 13/41; H01R 13/2442;
(Continued)

(56) References Cited

U.S. PATENT DOCUMENTS 5,746,607 A * 5/1998 Bricaud ..... H01R 12/714 439/630
5,746,626 A * 5/1998 Kwiat ..... H01R 13/2442 439/630
(Continued)

FOREIGN PATENT DOCUMENTS

JP 51-13550 1/1976
JP 57-112287 7/1982
(Continued)

OTHER PUBLICATIONS

Office Action from related Japanese Appln. No. 2012-248606, dated May 31, 2016. English translation attached.
(Continued)

*Primary Examiner* — Jean F Duverne
(74) *Attorney, Agent, or Firm* — Grossman, Tucker, Perreault & Pfleger, PLLC

(57) ABSTRACT

A contact includes: a spring member constituted of at least one thin plate that has electrical conductivity and elasticity, the spring member causing elastic deformation when being sandwiched between at least one conductor pattern of a printed wiring board and at least one conductive member different from the printed wiring board; a housing made of resin that surrounds at least a part of the spring member from both sides at least across a deformation direction of respective portions of the spring member so as to support the spring member on the printed wiring board; and at least a pair of engaging portions, the respective engaging portions being formed in the spring member and the housing, the engaging portions engaging with one another when the housing is arranged in a position surrounding the spring member, so as to secure at least a part of the spring member to at least a part of the housing.

3 Claims, 3 Drawing Sheets

(51) Int. Cl.

| | |
|---|---|
| ***H01R 13/24*** | (2006.01) |
| ***H01R 12/71*** | (2011.01) |
| ***H01R 43/02*** | (2006.01) |
| ***H01R 43/20*** | (2006.01) |
| *H01R 101/00* | (2006.01) |
| *H01R 13/40* | (2006.01) |

(52) U.S. Cl.
CPC ..... *H01R 13/2442* (2013.01); *H01R 13/2492* (2013.01); *H01R 43/0256* (2013.01); *H01R 43/205* (2013.01); *H01R 13/40* (2013.01); *H01R 2101/00* (2013.01)

(58) Field of Classification Search
CPC ..... H01R 43/0256; H01R 43/205; H01R 2101/00; H01R 31/02; H01R 27/00
USPC ..... 439/81
See application file for complete search history.

(56) References Cited

U.S. PATENT DOCUMENTS

| | | | | |
|---|---|---|---|---|
| 5,980,323 | A * | 11/1999 | Bricaud | G06K 7/0069 439/60 |
| 6,227,869 | B1 | 5/2001 | Lin et al. | |
| 6,398,598 | B2 * | 6/2002 | Masumoto | H01R 13/2442 439/862 |
| 6,454,607 | B2 * | 9/2002 | Bricaud | H01R 13/2442 439/180 |
| 6,984,130 | B2 * | 1/2006 | Richter | H01R 12/716 439/66 |
| 7,686,644 | B2 * | 3/2010 | Chu | H01R 13/2442 439/271 |
| 7,699,621 | B2 * | 4/2010 | Zhang | H01R 13/2442 439/74 |
| 7,727,033 | B2 * | 6/2010 | Tsuji | H01R 12/716 439/83 |
| 8,690,585 | B2 * | 4/2014 | An | H01R 13/41 439/66 |
| 2004/0127072 | A1 | 7/2004 | Matsunaga | |
| 2004/0132319 | A1 | 7/2004 | Richter et al. | |
| 2011/0003493 | A1 * | 1/2011 | Mo | H01R 27/00 439/81 |
| 2011/0201217 | A1 | 8/2011 | Koyama et al. | |
| 2012/0156903 | A1 * | 6/2012 | Kim | H01R 31/02 439/81 |
| 2013/0084718 | A1 * | 4/2013 | Kobayashi | H01R 13/2442 439/81 |

FOREIGN PATENT DOCUMENTS

| | | |
|---|---|---|
| JP | 3012677 | 4/1995 |
| JP | 8-222335 | 8/1996 |
| JP | 2004-111364 | 4/2004 |
| JP | 2004-127611 | 4/2004 |
| JP | 2004-146298 | 5/2004 |
| JP | 2004-207165 | 7/2004 |
| JP | 2005-032639 | 2/2005 |
| JP | 2009-206068 | 9/2009 |
| JP | 2011-014271 | 1/2011 |

OTHER PUBLICATIONS

International Search Report from corresponding PCT Appln. No. PCT/JP2013/079756 dated Feb. 4, 2014.

English translation of the International Preliminary Report on Patentability and Written Opinion from corresponding PCT Appln. No. PCT/JP2013/079756 dated May 14, 2015.

Partial Supplementary European Search Report from related EPO Appln. No. 13852428.5, dated Sep. 21, 2016. English translation attached.

Extended European Search Report from related EPO Appln. No. 13852428.5, dated Jan. 23, 2017.

* cited by examiner

CONTACT

CROSS-REFERENCE TO RELATED APPLICATION

This application claims priority from Japanese Patent Application No. 2012-248606 filed with the Japanese Patent Office on Nov. 12, 2012, the entire contents of which are hereby incorporated by reference.

TECHNICAL FIELD

The present invention relates to a contact that is surface mounted on a mounting surface of a printed wiring board and sandwiched with a conductive member different from the printed wiring board, so as to electrically connects a conductor pattern of the printed wiring board and the conductive member.

BACKGROUND ART

Conventionally, as this type of contact, there is proposed a contact obtained by processing a spring member constituted of a thin plate that has electrical conductivity and elasticity. The spring member is processed into a shape that causes elastic deformation when being sandwiched between the conductor pattern of the printed wiring board and the conductive member. Here, when the spring member is pressed from the direction intersecting with the deformation direction of the respective portions of the spring member, the spring member collapses and becomes unusable. Therefore, there is a proposal that a housing made of resin surrounds the spring member from both sides at least across the deformation direction of the respective portions of the spring member, so as to protect the spring member (see Patent Literature 1).

Here, the Patent Literature 1 does not describe the detail of the method for securing the spring member and the housing together. As an examples of the configuration that firmly secures a resin member and a spring member together, there is proposed the configuration where a spring member formed of one metal plate is secured by crimping a part of metal that constitutes the spring member to the resin member (for example, see Patent Literature 2).

CITATION LIST

Patent Literature

PATENT LITERATURE 1: Japanese Utility Model No. 3012677

PATENT LITERATURE 2: Unexamined Japanese patent application publication No. 2005-32639

SUMMARY OF INVENTION

Problems to be Solved by the Invention

However, to achieve the state where the housing made of resin surrounds the spring member (see Patent Literature 1) and the spring member is crimped to the housing so as to be secured (see Patent Literature 2), the spring member needs to be deformed by pressing in the state where the positional relationship between the spring member and the housing is accurately maintained. In the case where that pressing deformation is needed in the manufacture of the contact, the manufacture of the contact requires an expensive device.

According to one aspect of the present invention, it is preferred to provide a contact that has the configuration where a housing made of resin surrounds a spring member constituted of a thin plate that has electrical conductivity and elasticity and causes elastic deformation when being sandwiched between a conductor pattern of a printed wiring board and a conductive member; and is simply manufactured.

Solutions to the Problems

A contact according to one aspect of the present invention includes: a spring member constituted of a thin plate that has electrical conductivity and elasticity, the spring member causing elastic deformation when being sandwiched between a conductor pattern of a printed wiring board and a conductive member different from the printed wiring board; a housing made of resin that surrounds at least a part of the spring member from both sides at least across a deformation direction of respective portions of the spring member so as to support the spring member on the printed wiring board; and at least a pair of engaging portions, the respective engaging portions being formed in the spring member and the housing, the engaging portions engaging with one another when the housing is arranged in a position surrounding the spring member, so as to secure at least a part of the spring member to at least a part of the housing.

The contact thus configured according to one aspect of the present invention includes the spring member and the housing as follows. The spring member is constituted of the thin plate that has electrical conductivity and elasticity. The spring member causes elastic deformation when being sandwiched between the conductor pattern of the printed wiring board and the conductive member different from the printed wiring board. Accordingly, arrangement of the contact according to the present invention to cause elastic deformation when the spring member is sandwiched between the conductor pattern and the conductive member allows electrically coupling the conductor pattern and the conductive member together.

The housing is made of resin. The housing surrounds at least a part of the spring member from both sides at least across the deformation direction of the respective portions of the spring member. Further, the housing supports the spring member on the printed wiring board. Accordingly, the housing surrounds the spring member. This inhibits the collapse of the spring member even when the spring member is pressed from the direction intersecting with the deformation direction of the respective portions of the spring member.

The respective engaging portions are formed in the spring member and the housing. These engaging portions engage with each other when the housing is arranged in the position surrounding the spring member. Accordingly, the respective engaging portions secure at least a part of the spring member to at least a part of the housing. This allows securing respective parts of both the members together simply by inserting the spring member into the housing or externally fitting the housing to the spring member such that the positional relationship between both the members becomes the positional relationship where the housing surrounds the spring member. Accordingly, the contact according to one aspect of the present invention facilitates the manufacture without requiring an expensive device.

The spring member may be inserted into the housing by elastic deformation so as to apply a biasing force in the engaging direction to the respective engaging portions. In this case, using the elasticity of the spring member, at least a part of the spring member and at least a part of the housing can be more appropriately secured together.

Assuming that a portion in contact with the conductor pattern in the spring member is the first contact portion and a portion abutting on the printed wiring board in the housing is a board abutting portion, the first contact portion may project at the printed wiring board side with respect to the board abutting portion in a state where the respective engaging portions engage with one another and a load is not applied on the spring member except from the housing.

In that case, even when the accuracy for positioning the spring member and the housing is not so high, the first contact portion of the spring member can be reliably brought into contact with the conductor pattern of the printed wiring board. Here, in this case, it is possible to employ the configuration where the board abutting portion of the housing is spaced from the printed wiring board when an external force is not applied, and the board abutting portion abuts on the printed wiring board to support the spring member when an external force is applied to the spring member or the housing. In this case, the efficiency of soldering the spring member to the printed wiring board can be improved as follows. That is, if resin abuts on the printed wiring board, the resin hinders heat transfer to solder when the first contact portion is soldered to the printed wiring board. In contrast, in the case described above, the housing made of resin spaced from the printed wiring board inhibits the occurrence of this situation.

In that case, the board abutting portion may be arranged in respective two or more portions on both sides across the deformation direction of the respective portions of the spring member. In this case, the board abutting portions arranged in the respective two or more portions on both sides abut on the printed wiring board so as to more stably support the spring member. This more appropriately ensures contact between the spring member and the conductive member.

In the contact according to one aspect of the present invention, assuming that a portion in contact with the conductive member in the spring member is the second contact portion, the second contact portion may be constituted by separating the spring member into two parts, and the housing may also engage with the portion separated into two parts in the spring member in addition to the engagement of the engaging portions. In this case, since the housing engages with the portion separated into two parts in the spring member, the spring member is not turned back when the spring member receives a force to be pulled off from the printed wiring board. Since the second contact portion is separated into two parts, the spring member and the conductive member are in contact with each other at multiple contact points. Accordingly, the conductor pattern and the conductive member can be more reliably electrically connected to each other.

Next, an embodiment according to one aspect of the present invention will be described using one example.

DESCRIPTION OF REFERENCE NUMERALS

1 Contact
10 Housing
11, 12 Leg portion
13 Top plate
13C Through hole
15A, 15B, 15C, 35A, 35B, 35C Engaging portion
30 Spring member
31 First contact portion
33 Elastic contact portion
33A Folded portion
33B Planar portion
33C Second contact portion
33D Distal end portion

DESCRIPTION OF EMBODIMENTS

Figure 1A:
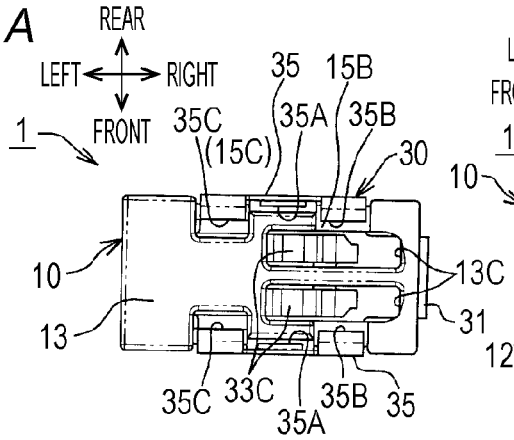
FIGS. 1A to 1G are views illustrating the configuration of a contact to which the present invention is applied.
Figure 1B:
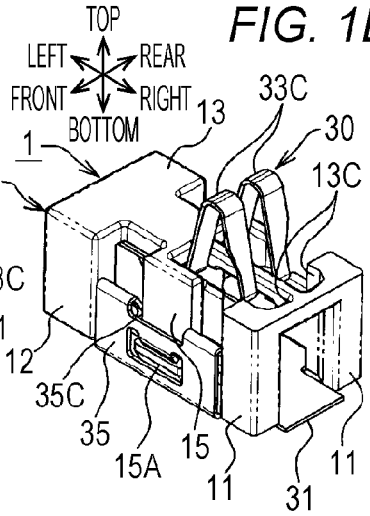
Figure 1C:
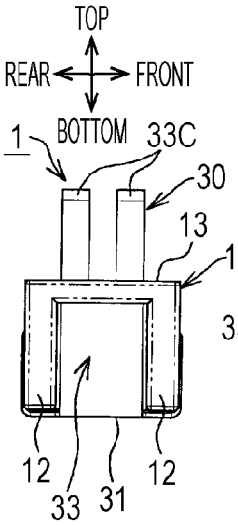
Figure 1D:
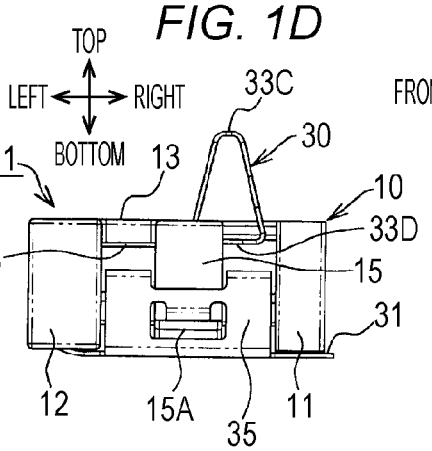
Figure 1E:
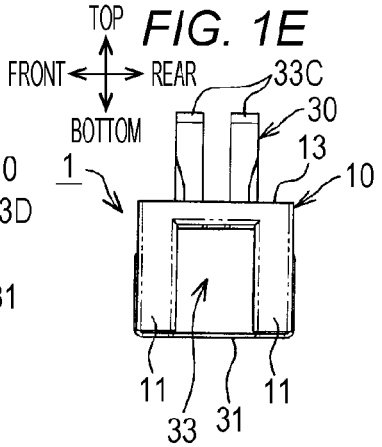
Figure 1F:
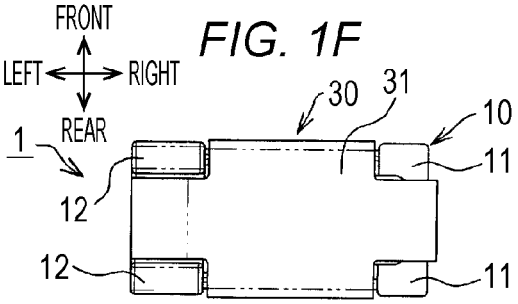
Figure 1G:
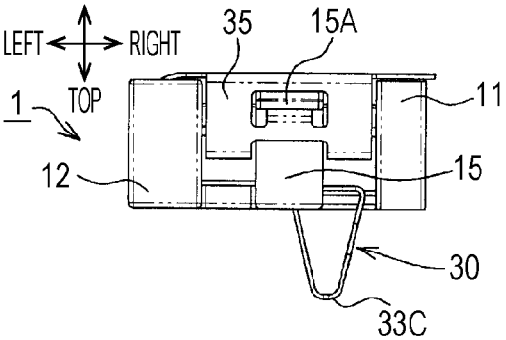

FIGS. 1A to 1G illustrate the configuration of a contact 1 as an example of an embodiment according to the present invention. FIG. 1A is a plan view, FIG. 1B is an upper right perspective view, FIG. 1C is a left-side view, FIG. 1D is a front view, FIG. 1E is a right-side view, FIG. 1F is a bottom view, and FIG. 1G is a rear view of the contact 1.

As illustrated in FIGS. 1A to 1G, the contact 1 is constituted such that a housing 10 made of resin and a spring member 30 of metal are assembled together. The spring member 30 is formed such that one thin plate made from a metal (such as phosphor bronze, beryllium copper, and SUS) having electrical conductivity and elasticity is punched into a predetermined shape and this punched plate is folded. Here, the punching process and the folding process may be performed in the reverse order or simultaneously.

Figure 2A:
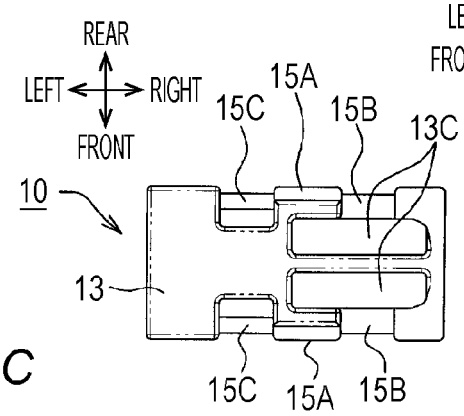
FIGS. 2A to 2G are views illustrating the configuration of a housing of the contact.
Figure 2B:
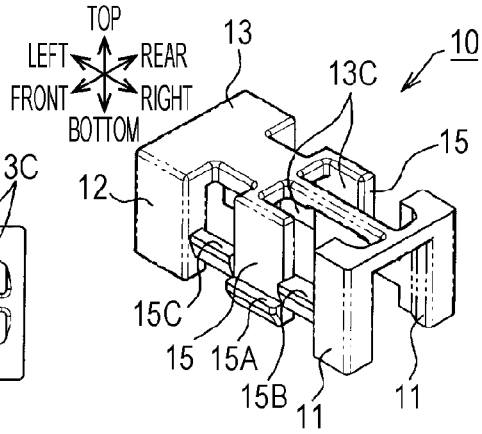
Figure 2C:
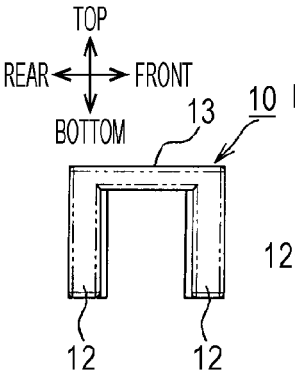
Figure 2D:
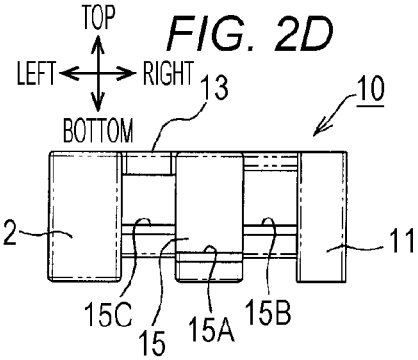
Figure 2E:
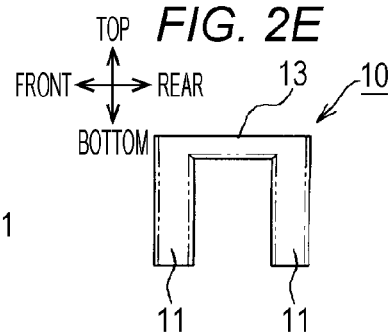
Figure 2F:
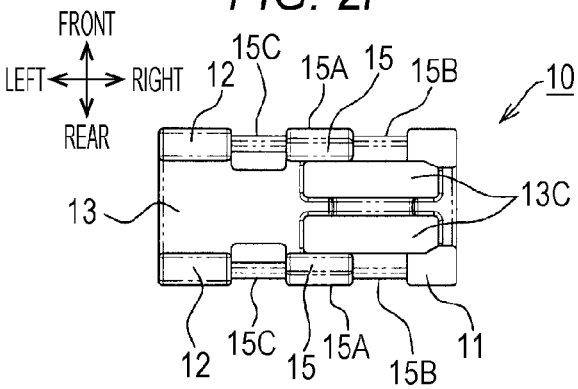
Figure 2G:
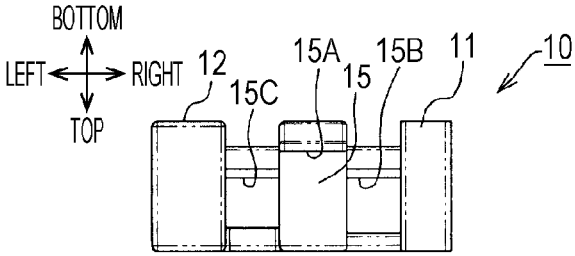
Figure 3A:
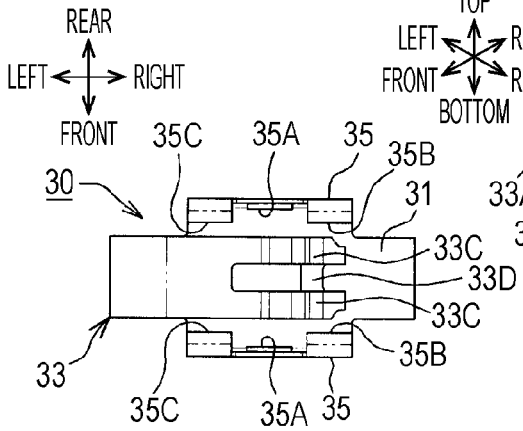
FIGS. 3A to 3G are views illustrating the configuration of a spring member of the contact.
Figure 3B:
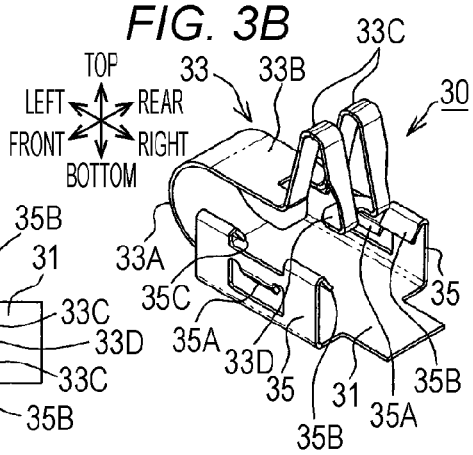
Figure 3C:
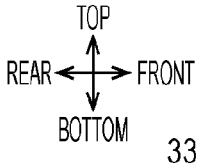
Figure 3C:
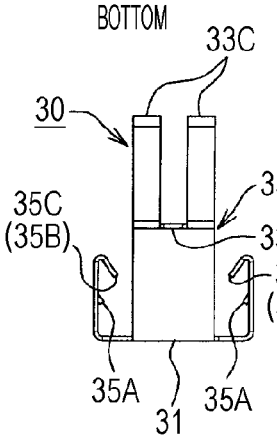
Figure 3D:
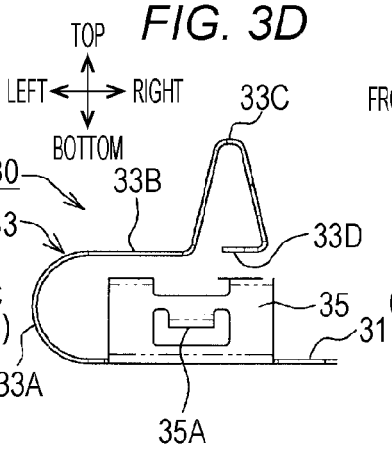
Figure 3E:
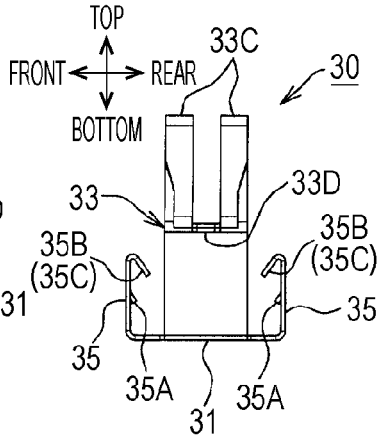
Figure 3F:
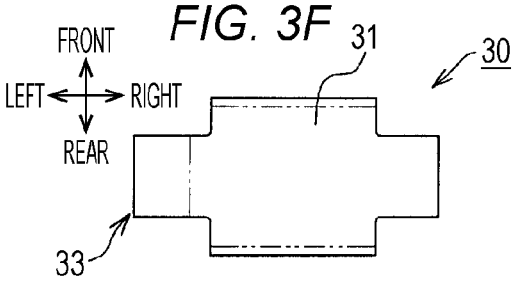
Figure 3G:
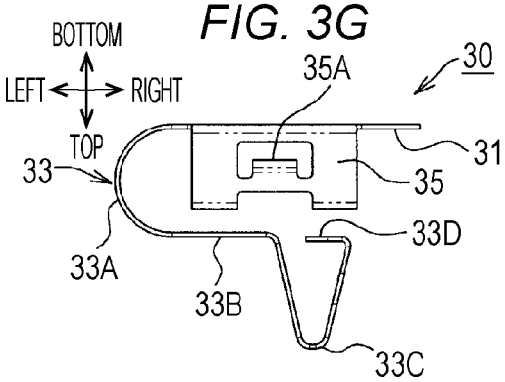

FIGS. 2A to 2G illustrate the configuration of the housing 10 in the contact 1. FIG. 2A is a plan view, FIG. 2B is an upper right perspective view, FIG. 2C is a left-side view, FIG. 2D is a front view, FIG. 2E is a right-side view, FIG. 2F is a bottom view, and FIG. 2G is a rear view of the housing 10. FIGS. 3A to 3G illustrate the configuration of the spring member 30. FIG. 3A is a plan view, FIG. 3B is an upper right perspective view, FIG. 3C is a left-side view, FIG. 3D is a front view, FIG. 3E is a right-side view, FIG. 3F is a bottom view, and FIG. 3G is a rear view of the spring member 30.

Here, in the following description, as front, rear, right, left, top, and bottom directions, the directions indicated by the arrows in FIGS. 1A to 3G are specified to describe the relative positional relationship between the respective portions of the contact 1. However, these directions are only definitions for describing the relative positional relationship between the respective portions of the contact 1. That is, these directions do not specify the mounting direction when the contact 1 is actually used or similar direction.

[Configuration of Housing]

As illustrated in FIGS. 1A to 1G and FIGS. 2A to 2G, the housing 10 includes a pair of leg portions 11, a pair of leg portions 12, and a top plate 13. The pair of leg portions 11 is arranged on the right side of the housing 10. The pair of leg portions 12 is arranged on the left side of the housing 10. The top plate 13 is supported by the pair of leg portions 11 and the pair of leg portions 12. The leg portions 11 and 12 are constituted to have respective horizontal cross sections of approximately rectangular shape. The leg portions 11 and 12 have the identical width in the front-rear direction. However, the leg portion 12 has a larger width in the right-left direction than that of the leg portion 11. On the top plate 13, a pair of through holes 13C is formed. The through hole 13C allows passage of the second contact portion 33C of the spring member 30 described later.

Further, from the center in the right-left direction on the respective sides at the front and rear of the top plate 13, a pair of support pillars 15 projects downward. The distal end (lower end) of the support pillar 15 constitutes an engaging portion 15A in upward hook shape (triangular shape) facing outward. Here, the lower end of the support pillar 15 is also arranged on the surface approximately in the identical plane to the inferior surfaces of the rectangular shapes of the leg portions 11 and 12. The lower end of the support pillar 15 assists when the top plate 13 and the spring member 30 described later are supported on a printed wiring board (not illustrated) by the leg portions 11 and 12. Between the support pillar 15 and the leg portion 11, engaging portions 15B in upward hook shape (triangular shape) facing outward are formed. Between the support pillar 15 and the leg portion 12, engaging portions 15C in upward hook shape (triangular shape) facing outward are formed.

[Configuration of Spring Member]

Next, as illustrated in FIGS. 1A to 1G and FIGS. 3A to 3G, the spring member 30 includes a first contact portion 31 having a plus shape in plan view. The inferior surface of the first contact portion 31 is a solder bonding surface described later. One end (left end) of the first contact portion 31 is continuously connected to an elastic contact portion 33. Here, more specifically, the first contact portion 31 has, as illustrated in FIG. 3F, a plus-shaped form where the portions facing the leg portions 11 and 12 are cut out at the four corners of a rectangular shape having a long side in the right-left direction in plan view. The elastic contact portion 33 includes a folded portion 33A that is curved into an arc shape in front view so as to have a lower end continuously connected to the left end of the first contact portion 31. The upper end of the folded portion 33A is continuously connected to a planar portion 33B, the second contact portion 33C, and a distal end portion 33D in this order.

The planar portion 33B is constituted to have a rectangular flat plate shape parallel to the first contact portion 31. The second contact portion 33C has an approximately triangular shape in front view and projects upward between the planar portion 33B and the distal end portion 33D which is arranged in the identical plane to the planar portion 33B. The upper end portion of the second contact portion 33C is rounded (chamfered). The distal end portion 33D is folded from the right edge of the second contact portion 33C in the planar portion 33B direction. Further, the elastic contact portion 33 is separated into two parts in the portion of the second contact portion 33C between the planar portion 33B and the distal end portion 33D.

At both front and rear ends of the first contact portion 31, a pair of side plates 35, which are disposed upright in the upward direction, are continuously connected to each other. Here, the inner wall surfaces of the respective side plates 35 are arranged in the positions abutting on the outer surfaces (both front and rear end surfaces) of the pair of support pillars 15 of the housing 10. Further, on the inner wall surfaces of the pair of side plates 35, plate-shaped engaging portions 35A, 35B, and 35C are lanced. The engaging portions 35A, 35B, and 35C engage with the respective engaging portions 15A, 15B, and 15C of the housing 10.

[Configuration and Effect of Contact]

The contact 1 according to the embodiment is obtained by pushing the housing 10 to the spring member 30 from upward such that the pair of support pillars 15 are positioned between the pair of side plates 35. At this time, the engaging portions 15A, 15B, and 15C engage with the engaging portions 35A, 35B, and 35C. At this time, the planar portion 33B and the distal end portion 33D of the spring member 30 are pressed by the inferior surface of the top plate 13 in the housing 10. Elastic deformation of the spring member 30 due to this pressing causes application of a biasing force to the respective engaging portions 35A, 35B, and 35C in the direction engaging with the engaging portions 15A, 15B, and 15C. Accordingly, the contact 1 appropriately secures the portion of the engaging portions 35A, 35B and 35C in the spring member 30 and the portion of the engaging portions 15A, 15B, and 15C in the housing 10 together using the elasticity of the spring member 30.

As illustrated in FIGS. 1B to 1E, when the housing 10 and the spring member 30 are assembled together as just described, the second contact portion 33C of the spring member 30 projects at the upper side with respect to the housing 10 via the through holes 13C. Further, as illustrated in FIGS. 1C to 1E, when the housing 10 and the spring member 30 are assembled together as described above, the first contact portion 31 of the spring member 30 projects at the lower side with respect to the inferior surfaces (equivalent to one example of a board abutting portion) of the leg portions 11 and 12.

The contact 1 thus constituted is used to cause elastic deformation when the spring member 30 is sandwiched between a conductor pattern of the printed wiring board and a conductive member (for example, a casing) different from the printed wiring board. In the embodiment, the printed wiring board side is described as the lower side. Accordingly, the inferior surface of the first contact portion 31 in the spring member 30 is soldered to the conductor pattern. The second contact portion 33C of the spring member 30 makes pressure contact with the conductive member due to the biasing force of the spring member 30. Accordingly, the conductor pattern and the conductive member can be electrically connected to each other. Accordingly, for example, in the case where the conductor pattern is an earth pattern and the conductive member is a grounding conductor, a measure for grounding the printed wiring board can be simply taken.

Further, in the state where a load is not applied on the spring member 30 except from the housing 10 as described above, the first contact portion 31 projects downward the lower side with respect to the inferior surfaces of the leg portions 11 and 12. This allows reliably bringing the first contact portion 31 of the spring member 30 into contact with the conductor pattern of the printed wiring board even when the accuracy for positioning the spring member 30 and the housing 10 is not so high. If resin abuts on the printed wiring board, the resin hinders heat transfer to solder when the first contact portion 31 is soldered to the printed wiring board. In contrast, in the embodiment, soldering is performed in the state where the housing 10 made of resin is spaced from the printed wiring board. This improves the efficiency during soldering.

As described above, when an external force is not applied to the contact 1 soldered to (mounted on) the surface (mounting surface) of the printed wiring board, the housing 10 is spaced from the printed wiring board. When an external force is applied to the spring member 30 or the housing 10, the inferior surfaces of the leg portions 11 and 12 of the housing 10 abut on the printed wiring board. Accordingly, the housing 10 causes the leg portions 11 and 12 to abut on the printed wiring board so as to surround at least a part of the spring member 30 (the base end portion of the second contact portion 33C, the most part of the folded portion 33A, and similar portion) from both the front and rear sides at least across the deformation direction of the respective portions of the spring member 30. Further, the housing 10 supports the spring member 30 on the printed wiring board. The spring member 30 is thus surrounded by the housing 10. This inhibits the collapse of the spring member 30 even when the spring member 30 is pressed from obliquely upward in the front-rear direction or similar direction intersecting with the deformation direction of the respective portions of the spring member 30.

Here, to inhibit the collapse of the spring member 30 as just described, it is preferred that the inferior surfaces of the leg portions 11 and 12 be spaced only slightly from the surface of the printed wiring board in the state where an external force is not applied. In this case, when an external force is applied to deform the spring member 30, all the four inferior surfaces of the leg portions 11 and 12 can immediately abut on the surface of the printed wiring board so as to appropriately support the spring member 30.

With the contact 1 according to the embodiment, simply pushing and mounting the housing 10 on the spring member 30 from upward as described above facilitates the manufacture. Accordingly, the contact 1 according to the embodiment can be simply manufactured without requiring an expensive device. That is, in the case where the housing 10 and the spring member 30 do not have the engaging portions and a part of the spring member 30 is crimped and attached from the outer periphery of the housing 10, it is necessary to cause pressing deformation of the spring member 30 while accurately keeping the positional relationship between the spring member 30 and the housing 10. In the case where the manufacture of the contact requires the pressing deformation, an expensive device is needed for the manufacture of the contact. In contrast, in the embodiment, it is only necessary to engage the spring member 30 with the housing 10. Accordingly, the contact 1 can be simply manufactured even by hand work. Further, in the case of crimping and attaching as described above, the housing 10 might be also stressed so as to cause a negative effect. However, the embodiment inhibits the occurrence of this situation.

The second contact portion 33C is constituted by separating the spring member 30 into two parts. In the housing 10, the top plate 13 between the through holes 13C engages with the portion separated into two parts. Accordingly, since the housing 10 engages with the portion separated into two parts in the spring member 30, the spring member 30 is not turned back when the second contact portion 33C receives a force to be pulled off from the printed wiring board. Further, since the second contact portion 33C is separated into two parts, the spring member 30 and the conductive member are in contact with each other at multiple contact points. Accordingly, the conductor pattern and the conductive member can be more reliably electrically connected to each other.

Other Embodiments of Present Invention

Here, the present invention is not limited to the above-described embodiment. The present invention can be embodied in various configurations without departing from the scope of the present invention. For example, it is possible to increase the size of the first contact portion 31 such that the inferior surfaces of the leg portions 11 and 12 abut on the top surface of the first contact portion 31. That is, the board abutting portion may abut on the printed wiring board via a part of the spring member. The distal end portion 33D may be arranged on the extending surface of the second contact portion 33C. The distal end portion 33D may be extended in the opposite direction to the planar portion 33B from the right edge of the second contact portion 33C. However, similarly to the latter configuration or the embodiment, the distal end portion 33D is preferred to be arranged in the identical plane to the planar portion 33B since the range of motion of the second contact portion 33C is larger. Further, the present invention is not limited to the configuration that includes the single spring member 30. For example, the present invention is similarly applicable to a contact that includes a plurality of spring members 30 like Patent Literature 1 described above.

What is claimed is:

1. A contact comprising:

a conductive spring member having a bonding surface to be bonded to a conductor pattern of a printed wiring board, the spring member causing elastic deformation by being sandwiched between the conductor pattern and a conductive member different from the printed wiring board; and a housing made of resin that engages with the spring member, the housing surrounding at least a part of the spring member from both sides at least across a deformation direction of respective portions of the spring member so as to support the spring member on the printed wiring board, wherein in a state where an external force does not act on the spring member or the housing when mounted on the printed wiring board, the bonding surface is in contact with the conductor pattern while the housing is spaced from the printed wiring board.

2. The contact according to claim 1, wherein the housing includes a leg portion that has an inferior surface, the inferior surface abutting on a surface of the printed wiring board when an external force acts on the spring member or the housing, and in a state where an external force does not act on the spring member or the housing, the inferior surface does not abut on the surface of the printed wiring board and the leg portion is spaced from the printed wiring board.

3. A method for mounting a contact on a printed wiring board, the contact including a housing and a conductive spring member having a bonding surface, the spring member causing elastic deformation by being sandwiched between the conductor pattern and a conductive member different from the printed wiring board, the housing being made of resin that engages with the spring member, the housing surrounding at least a part of the spring member from both sides at least across a deformation direction of respective portions of the spring member so as to support the spring member on the printed wiring board and including a leg portion that has an inferior surface, the inferior surface abutting on a surface of the printed wiring board when an external force acts on the spring member or the housing, the method comprising:

soldering the bonding surface to a conductor pattern of the printed wiring board, wherein the soldering is performed in a state where the housing is spaced from the printed wiring board and where the inferior surface does not abut on the surface of the printed wiring board when soldering the bonding surface and the printed wiring board together.

* * * * *